United States Patent [19]

Brimo

[11] Patent Number: 4,776,723

[45] Date of Patent: Oct. 11, 1988

[54] CONCRETE STAMPING TOOL

[76] Inventor: Elias J. Brimo, 13745 SW 106 Terrace, Miami, Fla. 33186

[21] Appl. No.: 57,345

[22] Filed: Jun. 2, 1987

[51] Int. Cl.[4] ..... E01C 23/02

[52] U.S. Cl. ..... 404/89; 404/93; 425/385; 425/458

[58] Field of Search ..... 404/89, 93, 133, 83, 404/124; 425/469, 385, 318, 458, 470; 249/15, 35

[56] References Cited

U.S. PATENT DOCUMENTS

| | | | |
|---|---|---|---|
| D. 257,824 | 1/1981 | Puccini et al. | D8/45 |
| D. 257,825 | 1/1981 | Puccini et al. | D8/45 |
| D. 272,037 | 1/1984 | Puccini | D8/45 |
| D. 282,623 | 2/1986 | Nasvik | D8/45 |
| 1,096,445 | 5/1914 | McKesson | 404/133 |
| 3,577,611 | 5/1971 | Hewitt | 425/385 X |
| 3,887,294 | 6/1975 | Leon | 404/89 |
| 3,930,740 | 1/1976 | Bowman | 404/93 |
| 4,105,354 | 8/1978 | Bowman | 404/89 |
| 4,128,357 | 12/1978 | Barth et al. | 404/41 |
| 4,131,406 | 12/1978 | Fresquez | 249/15 X |
| 4,135,840 | 1/1979 | Puccini et al. | 404/93 |
| 4,231,667 | 11/1980 | Roming | 404/89 |

FOREIGN PATENT DOCUMENTS

| | | | |
|---|---|---|---|
| 2176826 | 1/1987 | United Kingdom | 404/89 |

*Primary Examiner*—Jerome Massie, IV
*Assistant Examiner*—Matthew Smith
*Attorney, Agent, or Firm*—Jerry A. Miller

[57] ABSTRACT

An improved apparatus for stamping impressions in materials such as uncured concrete, includes a base member having an upper and a lower surface and an outer periphery, the outer periphery having a shape which provides a repetitive keyed pattern which may be fitted together with tools of similar shapes in a plurality of locations. An inner blade, having a predetermined cross-sectional geometry, is coupled to the lower surface of the base within the outer periphery. An outer blade surrounds the outer periphery of the base member at the lower surface, the outer blade having a cross-sectional geometry which is a bisection of the cross-sectional geometry of the inner blades, so that two adjacent tools abutted one against the other produce a composite blade at their border which has substantially the same cross-sectional geometry as that of the inner blade. The blades and base member are made of a flexible elastomeric material. A floor flange is molded into the base member to provide for attaching a handle to the upper surface of the base member. A strap handle coupled to the upper surface of the base member to facilitate handling.

19 Claims, 3 Drawing Sheets

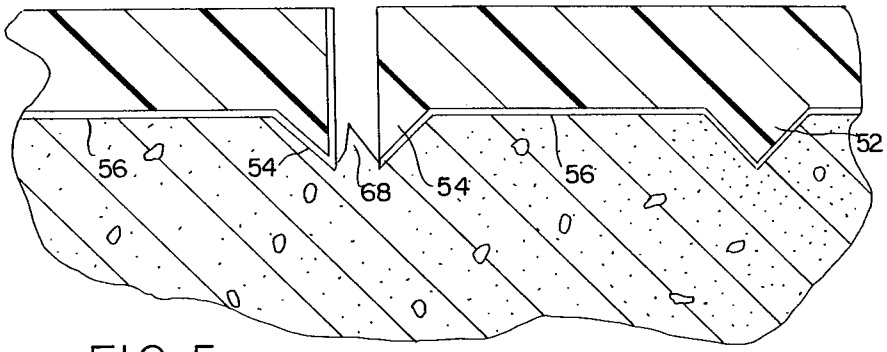
FIG. 5
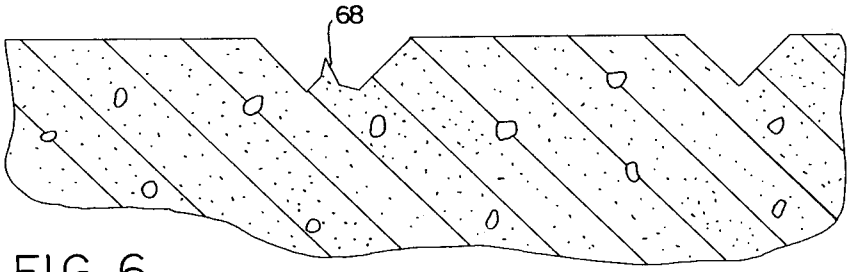
FIG. 6
FIG. 7
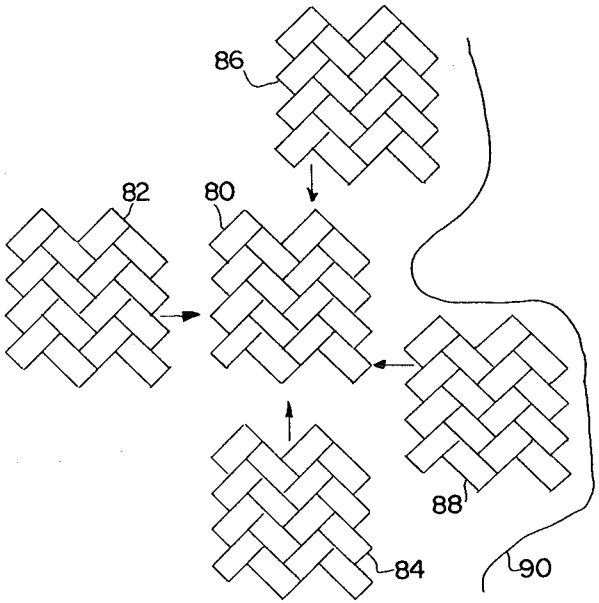

CONCRETE STAMPING TOOL

BACKGROUND OF THE INVENTION

1. FIELD OF THE INVENTION

This invention relates generally to the filed of concrete stamping or imprinting. More particularly, this invention relates to an improved concrete stamping tool for use in creating patterns in the surface of freshly poured concrete.

2. BACKGROUND

The process of concrete stamping is used to produce a simulated surface resembling that of, for example brick or stone, to provide an inexpensive and durable simulation of these materials. The process is carried out by first pouring a concrete mix and smoothing out the poured concrete. Next the surface of the mixture may be colored with vaious concrete color pigments such as those manufactured by The Burke Company. Then a concrete stamping tool (sometimes called an embossing tool or impressing tool) is pressed into the surface of the concrete to create various cuts and patterns in the surface of the concrete. When the concrete dries, the embossed surface resembles that of another material. For example, by coloring the surface of the concrete red, and making rectangular cuts in the surface to reach the uncolored concrete, the colored and formed concrete closely resembles laid brick. When the process is performed skillfully, only very close inspection will reveal otherwise.

The present invention relates to an improved tool for making such impressions in the surface of concrete. A number of tools have been used in the past to create these impressions in the concrete surface. For example, U. S. Pat. No. 3,930,740 to Bowman describes such a set of tools which are used to create irregular patterns in the concrete surface.

The first of these tools creates cuts in the surface of the concrete which are to represent intersections of the stones. Other tools are then used to connect the intersections one at the time to produce an irregular pattern. In other uses the first tool is used along to provide a symmetrical pattern. Although versatile, this tool provides for only a limited area which can be covered per tool and is thus slow to work with. Also, the blades of these tools meet in an area perpendicular to the channel cut by the blades making it difficult to create precise alignment of the channels. Any irregularityies in the channels such as those created by the joining of the tools makes it a less accurate reproduction of the material being simulated.

U. S. Pat. No. 4,135,840 to Puccini et al. relates to a stamping tool which is designed to simulate a block of irregular shaped stones but which is inconspicuously symmetrical about the sides so that the blades may be aligned in a variety of configurations to conceal the symmetry and create a variety of patterns. Due to it's side, there are inherently fewer places for the blades to intersect, thus producing a better appearance. But, the blades still join perpendicular to the channel.

U. S. Pat. No. 3,887,294 to Leon describes a concrete imprinting apparatus which uses a plurality of frames carrying the imprint to be stamped into the concrete by dropping them under the force of gravity. This patent describes a system which firmly attaches adjacent tools together and pulls them tight by spring force to create a more finished look. However, only a few of the tools can be attached together at a time and this technique cannot be conveniently used in all cases, such as when processing a very large or irregular shaped area. Moreover, the frame used to support the imprinting tools adds unnecessary cost to the hardware.

U. S. Pat. No. 4,231,677 to Roming describes a tool which approaches the problem slightly differently by providing interlocking tabs on the sides of the tools and by having the blades meet each other near the simulated brick corners. This provides a relatively clean look, but makes the tool somewhat less versatile since the tools will only properly align in a few orientations. Also, since the material of this and the other tools is very rigid, irregular shapes must be dealt with by smaller tools.

In addition, there are commercially available tools which are formed of an elastomeric material which permits an impression to be formed in the upper surface of the concrete between the conventional cuts. These tools also have problems in the area where two or more such tools join together as illustrated by FIG. 1. This FIGURE shows the area where two tools are joined together and pressed into the concrete. The first tool 10 includes a flat body 12 and a blade 14 which is placed adjacent a second tool 16 which also includes a flat body 18. The second tool also includes a blade 20 which is an interior blade of the tool.

At the area where the two tools are joined together, a small gap frequently appears due to slight misalignment of the two tools. This is a common situation since the tools must be used and moved quickly to avoid the concrete curing too much before the impressions are made. When the tools are pressed down to make the impressions, a small amount of concrete is forced upward through the small gap resulting in a finished impression as shown in FIG. 2 which has channels 24 and 26 as well as an unsightly "fin" 28. Often this fin 28 can be removed by chipping it away or even by sweeping if it is small and thin enough. However, occasionally relatively large fins are left which can not be repaired without damaging the surface. Such fins make the surface uncomfortable to walk on and create additional cost in completing the job.

The present invention lessens these problems with an improved tool which provides reduction of the fin problem, enhanced versatility in creating edges and irregular shapes as well as providing easy alignment of adjacent tools in numerous versatile configurations. The present invention provides further advantages and features which are not contemplated by the prior art as will be appreciated after consideration of the following description taken in conjunction with the accompanying drawings.

SUMMARY OF THE INVENTION

Accordingly, it is an object of the present invention to provide an improved concrete stamping tool.

It is another object of the present invention to provide a concrete stamping tool which is simple to use and easy to align in various configurations to account for irregular shaped areas.

It is another object of the present invention to provide a concrete stamping tool which has improved characteristics resulting in reduction of the problem with creation of "fins" of concrete between adjacent tools.

It is another object of the present invention to provide a concrete stamping tool which is simple to manufacture.

It is an advantage of the present invention that fins created by slight misalignment of adjacent tools are substantially hidden.

It is another advantage of the present invention that the tools may be coupled together in a variety of ways to facilitate use on irregular shaped patios, walkways and the like.

In one embodiment of the present invention an improved apparatus for stamping impressions in materials such as uncured concrete, includes a base member having an upper and a lower surface and an outer periphery. An inner blade has a predetermined cross-sectional geometry and is coupled to the lower surface of the base within the outer periphery. An outer blade surrounds the outer periphery of the base member at the lower surface. The outer blade has a cross-sectional geometry which is a bisection of the cross-sectional geometry of the inner blades, so that two adjacent tools abutted one against the other produce a composite blade at their border which has substantially the same cross-sectional geometry as that of the inner blade.

In another embodiment of the present invention, an apparatus for producing impressions in concrete or the like includes an outer blade defining a closed area, for cutting an outer channel having a first cross-sectional geometry in the concrete. An inner blade is disposed within the closed area for cutting an inner channel having a second cross-sectional geometry in the concrete. the first cross-sectional geometry is a bisection of the second cross-sectional geometry.

In another embodiment of the present invention an improved apparatus for stamping impressions in materials such as uncured concrete, includes a base member having an upper and a lower surface and an outer periphery, the outer periphery having a shape which provides a repetitive keyed pattern which may be fitted together with tools of similar shapes in a plurality of locations. An inner blade, having a predetermined cross-sectional geometry, is coupled to the lower surface of the base within the outer periphery. An outer blade surrounds the outer periphery of the base member at the lower surface, the outer blade having a cross-sectional geometry which is a bisection of the cross-sectional geometry of the inner blades, so that two adjacent tools abutted one against the other produce a composite blade at their border which has substantially the same cross-sectional geometry as that of the inner blade. The blades and base member are made of a flexible elastomeric material. A floor flange is molded into the base member to provide for attaching a handle to the upper surface of the base member. A strap handle coupled to the upper surface of the base member to facilitate handling.

These and other objects, features, and advantages of the invention will become apparent to those skilled in the art upon consideration of the following detailed description taken in conjunction with the accompanying drawings.

BRIEF DESCRIPTION OF THE DRAWINGS

FIG. 5 is a view of the area of joining of two tools according to the present invention.

FIG. 6 is a side view of the finished impression made in FIG. 5.

FIG. 7 is a view of a plurality of the tool of the present invention in various alignments.

DETAILED DESCRIPTION OF THE INVENTION

Figure 1:
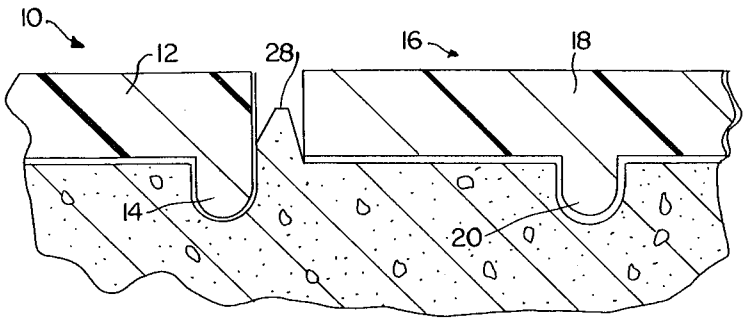
FIG. 1 (PRIOR ART)
FIG. 1 is a drawing of a pair of prior art tools in use.
Figure 2:
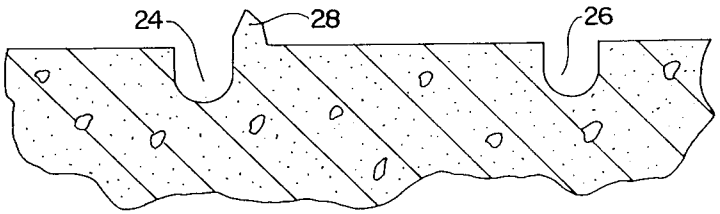
FIG. 2 (PRIOR ART)
FIG. 2 is a side view of the results of use of the tools in FIG. 1.
Figure 3:
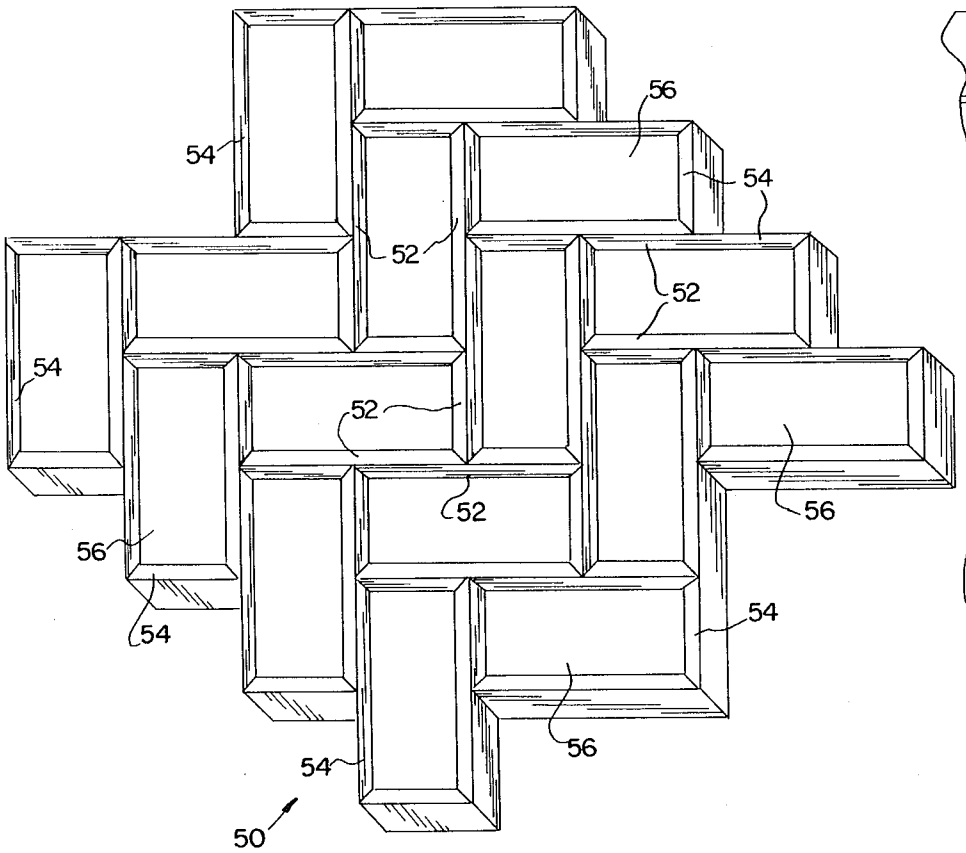
FIG. 3 is a view of the bottom surface of one embodiment of a tool according to the present invention for producing a herringbone brick pattern in concrete.

Turning now to the drawings wherein like reference numerals designate identical or corresponding parts throughout the several views, and more particularly to FIG. 3 thereof, there is shown an embodiment of the concrete stamping tool 50 of the present invention. This tool is shown as a tool which produces a herringbone pattern in the concrete, but as will be appreciated after consideration of the present description, this is not limiting as numerous other patterns are possible for use with the present invention.

Tool 50, is molded from U-2 CMC urethane Elastomer available from Perma-Flex Mold Co., Columbus, Ohio which is a room temperature curing material which forms a relatively hard yet flexiable rubber-like material when cured. Tool 50 includes a plurality of inner blades 52 which may be of any appropriate shape. In the preferred embodiment, these blades are a triangular cross-sectional shape so that the channel cut by these blades is triangular in cross-section. Other shapes may be used according to the desired pattern to be formed. Along the periphery of the tool, there are provided outer blades 54 which are half the shape of the inner blades 52 so that when two of the outer blades 54 of the tools are placed together, they make up the equivalent of an inner blade. That is, the trianglar cross-section of the outer blade 54 plus a mirror image of itself creates a triangle similar to that of the cross-section of the inner blades 52.

A flat portion 56 of the tool, which serves as a carrier for the tool's blades may also have patterns impressed in the face thereof to produce simulated texture of the material being simulated inconcrete. The tool has a total thickness of approximately $1\frac{3}{4}$ inches in the preferred embodiment with the depth of the blades accounting for approximately $\frac{1}{2}$ inch of this overall thickness. This thickness provides adequate durability in the material while not making the tool too heavy to work with. For the herringbone pattern illustrated, each of the bricks is approximately 4 inches by 8 inches for an overall size of roughly two feet square.

Figure 4:
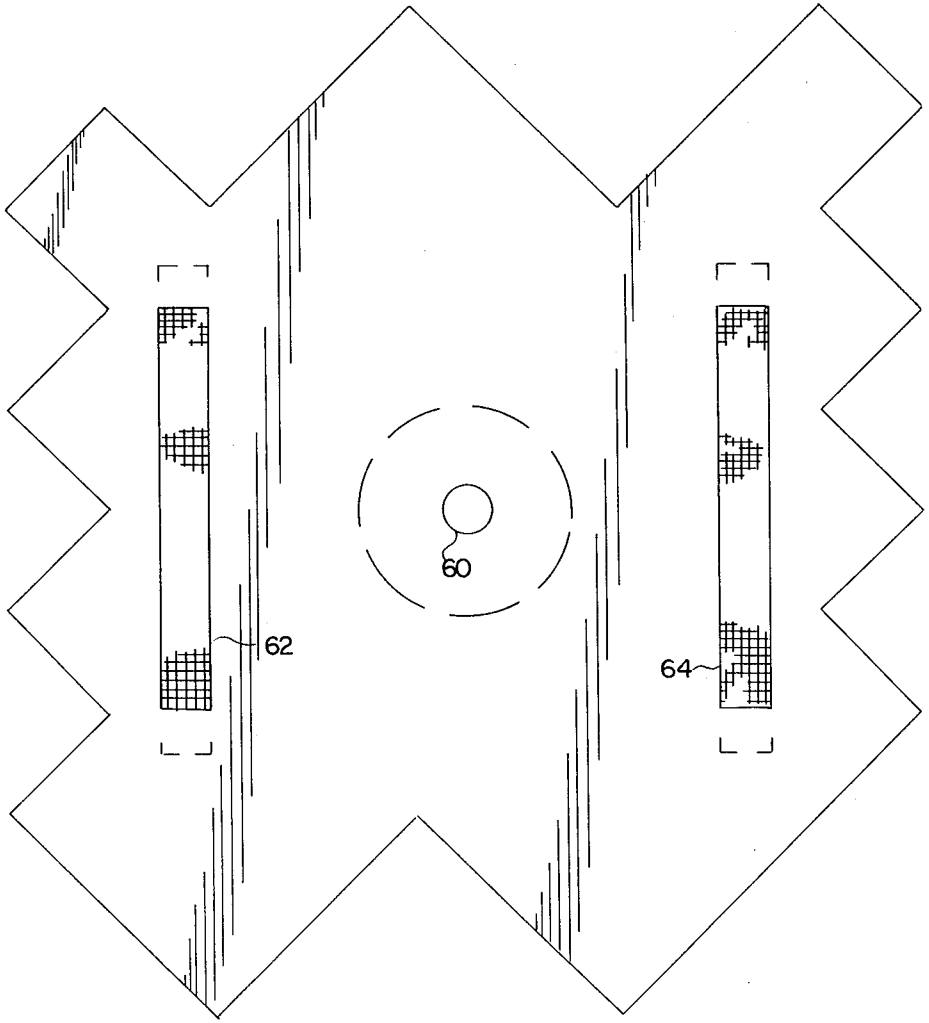
FIG. 4 is a top view of the herringbone pattern tool shown in FIG. 3.

Turning now to FIG. 4, the top of the tool is shown. The upper surface is substantially planar with a floor flange 60 molded into the center of the tool. The floor flange 60 preferably accepts a 1 inch threaded pipe for use as a handle when operating the tool. Also molded into the top of the tool, ar a pair of straps 62 and 64 to facilitate handling, carrying and aligning the tools. These straps are, in one embodiment, made of the same material used for automobile seat belts. The ends of the straps are simply placed in the elastomer during the molding process and allow to harden in place. More or few staps may be desirable in various locations for other embodiments. The straps also serve, as presently shown, to provide a quick visual indication of the orientation of the tool since the actual pattern is generally facing down.

Turning now to FIG. 5 viewed in conjunction with FIG. 6, a view of the present tools in operation shows that the outer blades 54, if misaligned, produce a fin 68 which is hidden within the channel created in the concrete. This fin 68 may be similarly removed by sweeping if small enough. However if large enough that it is not easily removed, the fin may simply be left as is since it is relatively inconspicuous within the channel. The fin being in the channel, if produces no unacceptable roughness in the actual walking surface and is substantially less noticeable than that created by the prior art. And, since there are no joints which are created by the perpendicular joining of two blades. there remains a continuous flow of the pattern which simulates the actual brick (or whatever) pattern faithfully.

Turning now to FIG. 7, a plurality of the present tools are shown (absent unnecessary detail) to illustrate a further advantage of the present invention. The present tool is especially well suited to dealing with irregular shaped patios, walkways, etc. By splitting the blade used to form the channels at the periphery of the tool, the tools may be fitted together in a variety of ways limited only by the particular pattern being simulated. Of course, the present illustration shows only a herringbone pattern, but numerous other patterns may be utilized in conjunction with the present invention.

With careful thought and planning, irregular patterns may also utilize the present invention in many situations. However, the present invention is most conducive to use with somewhat symmetrical patterns such as the herringbone pattern or traditional brick or block patterns. The herringbone pattern is a good example of the type of pattern useful in implementing the present invention. Such a pattern could be created with any of a number of tool configuration. The configuration shown in especially advantageous because the outer periphery of the tool is keyed by selecting the border of the tool along a zig-zag edge of the herringbone pattern. Normally, it is considered wise to select such patterns along a straight edge and to produce special deformities such as tabs or extra or missing bricks to allow for keying of the patterns together. However, by selection of the zig-zag edge as the periphery of the tool, natural keys are created all along the edge to allow the tools to be fitted together in a variety of ways.

FIG. 7 shows that in addition to the normal relationships of the tools 80, 82 and 84, the tools fit together in numerous other ways to allow for irregular concrete shapes. For example, tool 86 and tool 88 are placed to allow for close conformance to the irregular edge of a sidewalk 90. Careful examination reveals that two of the present tools may fit together in any of at least six different ways along the sides of the tool and any of three different ways along the top of the tools for the herringbone embodiment. This allows heretofore unrealized flexibility in placement of the tools while creating an interlocking arrangement at each possible position to produce true edges for good pattern alignment with minimum "walking" of the pattern.

The material selection and manufacture of the present tool also allows for easy treatment of the edges of a slab of concrete to be processed. Often the edge of the concrete will be treated with a different pattern to form a decorative border. With normal tool, this becomes quite a problem since this must be handled either with much smaller tools or using other special processes. Since the tool of the present invention is somewhat flexible, the border may simply be masked off using a thin board such as ⅛ inch plywood and the tool simply draped over the masked area. This allows the present tool to be used right up to the border with minimal touch-up while continuing to produce a faithful replica of the simulated pattern. Thus, the flexibility of the present tool makes it's use even more productive and allows a minimal number of tools to actually be needed to perform a particular task.

The present invention may be manufactured in many ways with numerous variations which will occur to those skilled in the art after consideration of this illustrative embodiment. For example, rather than use of a room temperature curing elastomer, an injection molding process with molten material may be substituted. Similarly, other materials may be used, either rigid or flexible, as desired to facilitate various goals. Also, other cross-sectional geometries for the blades may be used with good results without departing form the present invention.

THUS, it is apparent that in accordance with the present invention, a method and apparatus that fully satisfies the aims, advantages and objectives is set forth above. While the invention has been described in conjunction with specific embodiments, it is evident that many alterations, variations and modifications will become apparent to those skilled in the art in light of the foregoing description. Accordingly, it is intended that the present invention embrace all such alternatives, modifications and variations as fall within the spirit and broad scope of the appended claims.

What is claimed as new and desired to be secured by Letters Patent of the United States is:

1. An improved apparatus for stamping impressions in materials such as uncured concrete, comprising in combination:

a base member having an upper and a lower surface and an outer periphery;

an inner blade, having a predetermined crosssectional geometry, coupled to said lower surface of said base within said outer periphery; and an outer blade coupled to said lower surface of said base member and surrounding said outer periphery of said base member at said lower surface, said outer blade having a cross-sectional geometry which is a bisection of said cross-sectional geometry of said inner blades, so that two adjacent tools abutted one against the other produce a composite blade at their border which has substantially the same cross-sectional geometry as that of said inner blade.

2. The apparatus of claim 1, further comprising means for attaching a handle to said upper surface of said base member.

3. The apparatus of claim 2, wherein said handle attaching means includes a floor flange molded into said base member.

4. The apparatus of claim 1, further comprising a strap handle coupled to the upper surface of said base member

5. The apparatus of claim 1, wherein said outer blade has a shape which provides a keyed pattern which may be fitted together with tools having an outer blade having said shape.

6. The apparatus of claim 5, wherein said keyed pattern is of a shape which allows said tools having an outer blade having said shape to be fitted together with said apparatus in a plurality of locations.

7. The apparatus of claim 5, wherein said keyed pattern is a repetitive keyed pattern.

8. The apparatus of claim 1, wherein said inner blades are of approximately triangular cross-section.

9. The apparatus of claim 8, wherein said outer blades are of approximately triangular cross-section so that the cross-section of said outer blade plus a mirror image thereof produces approximately the cross-section of said inner blade.

10. The apparatus of claim 1, further including a plurality of inner blades which, in conjunction with said outer blades, produce a predetermined pattern for imprinting in said concrete.

11. The apparatus of claim 1, wherein said blades and base member are molded from a flexible elastomeric material.

12. An apparatus for producing impressions in concrete or the like, comprising in combination:

a base member having a lower surface;

outer blade means, coupled to said lower surface of said base and defining a closed area, for cutting an outer channel having a first cross-sectional geometry in said concrete;

inner blade means, coupled to said lower surface of said base and situated within said closed area for cutting an inner channel having a second cross-sectional geometry in said concrete; and wherein said first cross-sectional geometry is a bisection of said second cross-sectional geometry.

13. The apparatus of claim 12, further comprising a flexible supporting base means for supporting said inner and outer blade means.

14. The apparatus of claim 12, wherein said closed area defined by said outer blade defines a shape which provides a keyed pattern which may be fitted together with tools of similar shape.

15. The apparatus of claim 14, wherein said keyed pattern is a repetitive keyed pattern.

16. An improved apparatus for stamping impressions in materials such as uncured concrete, comprising in combination:

a base member having an upper and a lower surface and an outer periphery, said outer periphery having a shape which provides a repetitive keyed pattern which may be fitted together with tools of similar shaped in a plurality of locations;

a plurality of inner blades, each having a predetermined crosssectional geometry, each coupled to said lower surface of said base within said outer periphery; and an outer blade coupled to and surrounding said outer periphery of said base member at said lower surface, said outer blade having a cross-sectional geometry which is a bisection of said cross-sectional geometry of said inner blades, so that two adjacent tools abutted one against the other produce a composite blade at their border which has substantially the same cross-sectional geometry as that of said inner blade;

said blades and base member being made of a flexible elastomeric material;

means for attaching a handle to said upper surface of said base member; and a strap handle coupled to the upper surface of said base member.

17. The apparatus of claim 1, wherein said outer blade extends downward from said base a right angle with respect to said base at said outer periphery.

18. The apparatus of claim 1, wherein said base means includes an outer periphery and wherein said outer blade means extends downward from said base means a right angle with respect to said base at said outer periphery.

19. The apparatus of claim 16, wherein said outer blade extends downward from said base a right angle with respect to said base at said outer periphery

* * * * *